United States Patent [19]

Evans

[11] 4,325,364

[45] Apr. 20, 1982

[54] TRAINING BREATHING APPARATUS

[75] Inventor: John D. Evans, Balerno, Scotland

[73] Assignee: Coal Industry (Patents) Limited, London, England

[21] Appl. No.: 972,935

[22] Filed: Dec. 26, 1978

[30] Foreign Application Priority Data

Jan. 10, 1978 [GB] United Kingdom ..... 00853/78

[51] Int. Cl.[3] ..... A62B 7/00

[52] U.S. Cl. ..... 128/201.13; 128/202.26; 128/204.17; 434/226; 434/262

[58] Field of Search ..... 128/147, 142 R, 191 R, 128/201.13, 202.26, 205.28, 204.17; 55/DIG. 33, DIG. 35; 35/17

[56] References Cited

U.S. PATENT DOCUMENTS 3,655,346 4/1972 Cotabish et al. ..... 128/191 R X 3,908,649 9/1975 Eckstein ..... 128/147

4,090,511 5/1978 Gray ..... 128/147

OTHER PUBLICATIONS

Katz et al., The Universal and The Fireman's Gas Masks, May 23, 1923, Dept. of the Interior-Technical Paper 300.

*Primary Examiner*—Henry J. Recla

*Attorney, Agent, or Firm*—Stevens, Davis, Miller & Mosher

[57] ABSTRACT

To simulate the experience of breathing hot or warm air in the use of breathing apparatus, this invention provides an apparatus comprising a canister through which the wearer inhales and exhales, the canister being filled with a reagent which creates heat by reaction with the carbon dioxide or moisture in the exhaled breath. The inhaled air absorbs the heat given out by the reaction. The apparatus can be modelled on the actual breathing apparatus to be used and is highly acceptable to users.

7 Claims, 1 Drawing Figure

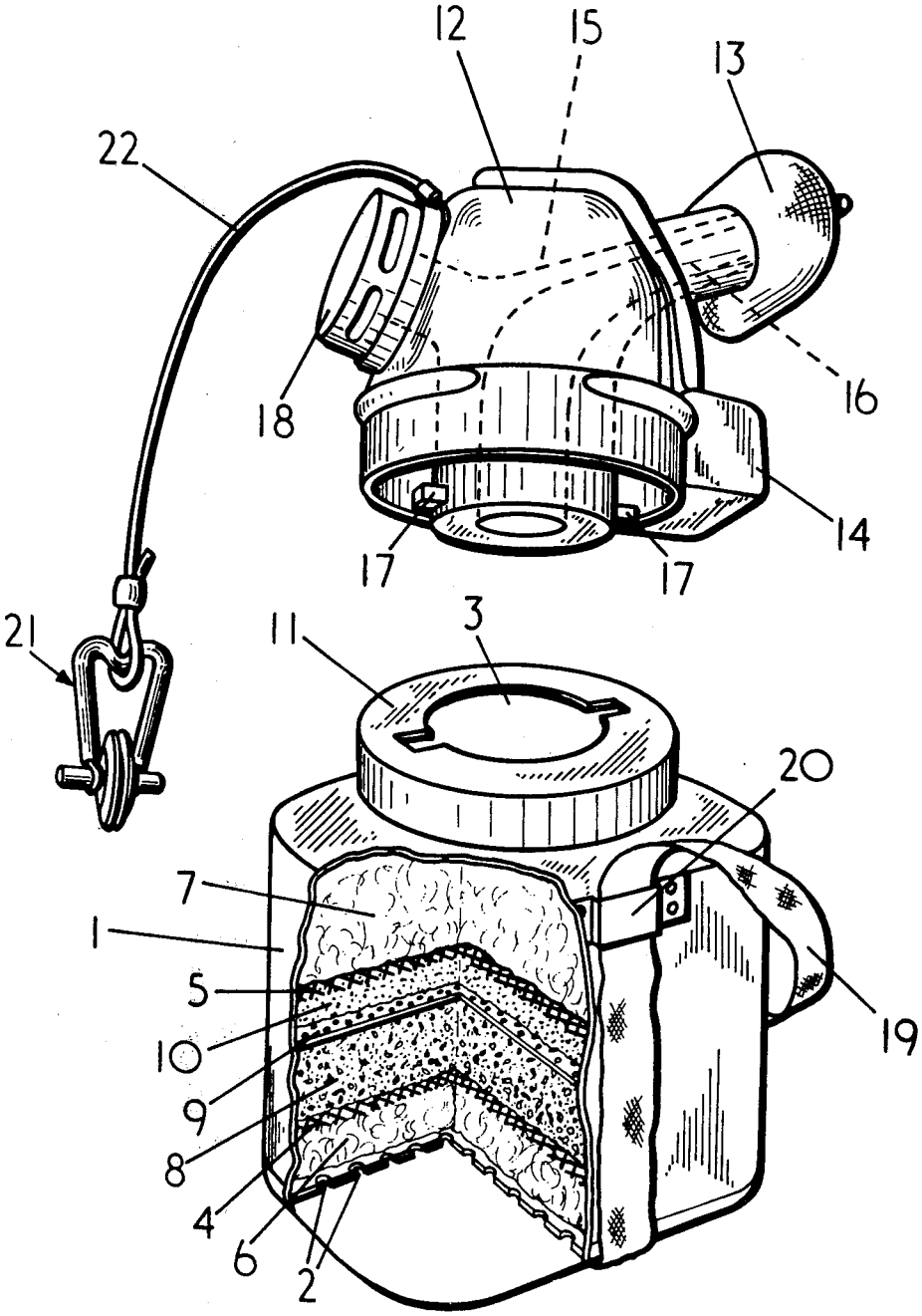
12
15
13
22
18
16
14
17
17
21
11
3
20
7
1
5
10
9
8
4
6
2
19

TRAINING BREATHING APPARATUS

The present invention concerns breathing apparatus and more particularly concerns an apparatus for training people in the use of the type of breathing apparatus termed "self-rescuers".

Self-rescuers are a type of breathing apparatus which do not provide oxygen but which remove noxious gases such as carbon monoxide from the atmosphere to be breathed. It is a condition of employment in the National Goal Board and is to become a statutory requirement that anyone going underground in a coal mine in Britain has to carry a self-rescuer. While the self-rescuer has proved its ability to save life in situations where a mine explosion or fire has created dangerous quantities of carbon monoxide, by allowing about one hour in which the wearer can reach a less dangerous environment, certain drawbacks are attached to their use. Inside a self-rescuer there is a catalyst known as "Hopcalite" which enables carbon monoxide to be oxidised by atmospheric oxygen. The catalytic oxidation is accompanied by the evolution of considerable amounts of heat depending upon the carbon monoxide concentration and various methods are used by equipment manufacturers to cool the air and to protect the wearer. The self-rescuer incorporates an air drying medium which protects the catalyst from poisoning by moisture. The air breathed is warm and dry. No ill effects follow from breathing such hot, dry air, but there is the considerable danger that individual wearers may be taken by surprise despite warnings during training sessions that heat is evolved. It was therefore perceived that there was a need for some form of training of miners in the breathing of hot dry air.

The present invention provides a warm air training model breathing apparatus comprising a canister through which the wearer inhales and exhales and which canister contains a reagent which creates heat by reaction with the carbon dioxide and/or moisture in the exhaled air, whereby the inhaled air absorbs the heat given out by said reaction.

The canister may contain two or more reagents in discrete layers or may contain a mixture of reagents provided there is no adverse interaction between them. Clearly, the reagent should be safe in use, and not give off noxious substances.

It is preferred that the canister contains a carbon dioxide absorption agent, most preferably soda-lime, and a discrete layer of a drying agent, such as active carbon impregnated with lithium halides, and that the drying agent is positioned closer to the wearer than the $CO_2$ absorption agent. This ensures that the air inhaled is both hot and dry and thus closely resembles the air inhaled from a real self-rescuer in a CO-containing atmosphere.

Soda-lime is normally commercially available with a relatively high moisture content. To achieve a reasonable shelf-life it is desirable to dry the soda-lime to avoid migration of moisture to the drying agent; this does not affect the use of the apparatus of the invention.

Although the invention finds special application in simulating filter self-rescuers, the invention may find application in simulating other types of breathing apparatus and hence is not to be limited in this respect. For example the use of a commercial compressed oxygen breathing apparatus also results in the wearer breathing hot air.

Since it is desirable that the warm air training model resembles the apparatus as closely as possible, it is preferred that visually and in weight the training model resembles a commercial breathing apparatus. In the case of British coal mines, the self-rescuer provided is manufactured and sold by Mine Safety Appliances Company Limited of Coatbridge, but other self-rescuers are available in other parts of the world from other manufacturers.

The invention will now be described by way of example only with reference to the accompanying drawing, which is an exploded view of a warm air self rescuer training model, partly in section.

A training model self-rescuer comprises a canister 1, having perforations 2 in its base and an outlet 3 in its top. To retain the contents of canister 1, wire mesh sieves 4, 5 are spot welded to the canister and polyester dust filters 6, 7 are provided. Above the lower dust filter, 6, there is a layer, 8, of 100 g to 130 g dried 6–10 mesh soda lime (e.g. "Protosorb" obtainable from Siebe-Gorman or Sutcliffe-Speakman, England), then a loosely fitted coarse metal sieve, 9, of wire mesh or perforated metal. Above sieve 9 there is a further layer, 10, of 50 g drying agent (lithium halides on active carbon).

Mounted by means of a simple bayonet connector plate 11 on canister 1 is a hallow rubber mouthpiece housing 12 on which is fitted a standard self-rescuer mouthpiece 13 and a chin protector, 14. The housing incorporates a hard plastics insert, 15, which has an internal passage, 16, from the mouthpiece to the canister, and is provided with prongs 17 to engage the connector plate 11. The standard MSA self-rescuer has an exhalation valve in the mouthpiece housing, but in the training model a blanked-off non-functional valve head, 18, is provided, retaining the appearance of the valve in the standard self-rescuer. To ensure that there is no danger of a non-functional valve being fitted to a real self-rescuer, a different fitting, e.g. a different thread, is used in the training model.

To provide support for the canister when the warm air training model is worn, a headstrap 19, shown in part is attached by means of spring clips, 20. A nose-clip, 21, is attached by synthetic fibre cord, 22 to the blank valve head, 18.

In use, the person being trained inserts the mouthpiece in his mouth, puts on the nose-clip then the headstrap and adjusts it. It is preferred to blow out any dust left by the manufacturing process by connecting the canister to a high pressure compressed air line for 10 to 15 seconds, although this may also be accomplished less efficiently by exhaling before inhaling; this serves in the training model to heat up the mass of layers 8 and 10 by reaction with $CO_2$ and moisture respectively. On inhaling, the air is heated up on its passage through the container and within two or three minutes provides dry air at 60° C. to 70° C. This temperature is equivalent to using a self-rescuer in an atmosphere containing 1 to $1\frac{1}{4}$% carbon monoxide at normal breathing rates. It is believed that the wearer's ventilation regulates the quantity and rate of heat production without the need for auxiliary control equipment to adjust or check. It is a completely portable apparatus, identical in size and shape to the standard self-rescuer and there is no greater restriction of movement than with the standard self-rescuer. About 15 to 30 minutes training can be given with the training model and it is the first time a relatively cheap, portable and realistic training model providing warm dry air to the wearer has been produced. The canister may be a throw-away unit or may be fitted with a disposable cartridge containing the reagents. In any event, the mouth piece unit is easily removable and may be sterilized or washed for re-use.

Tests carried out at collieries and a mine rescue station show that there is 100% acceptance of a test apparatus according to the invention by users. The users feel the canister becoming hot and experience dryness of the throat but the overall conclusion was that the test apparatus was comfortable to use. Use of the apparatus of the invention is seen to truly simulate use of a real self-rescuer and overcomes the apprehension induced by training lectures which stress that hot dry air is breathed.

I claim

1. A warm air training model breathing apparatus comprising:

a breathing air conduit having a first end for receiving exhaled air from a user and supplying inhaled air to a user;

a canister having a first opening connected to a second end of said breathing conduit and a second opening communicating with ambient atmosphere, said canister containing, between said first and second openings, a reagent which creates heat by reaction with carbon dioxide and/or moisture in exhaled air, said canister including passage means for directly passing inhaled air from said second opening through said reagent where it is heated and through said first opening to said breathing conduit to a user and passing exhaled air from a user from said breathing conduit through said first opening, through said reagent causing generation of heat, and through said second opening to ambient atmosphere.

2. An apparatus as claimed in claim 1, wherein the reagent creates heat by reaction with carbon dioxide and is soda lime.

3. An apparatus as claimed in claim 2, wherein a discrete layer of drying agent is provided in said canister in the flow path of inhaled and exhaled air.

4. An apparatus as claimed in claim 3, wherein the drying agent is active carbon impregnated with one or more lithium halides.

5. An apparatus as claimed in claim 1, wherein the canister includes a housing removably connected to said breathing conduit.

6. An apparatus as claimed in claim 5 wherein said breathing conduit second end is an insert fitted into said housing and said insert has connector elements enabling its connection to said housing and a mouthpiece is connected to the first end of said breathing conduit.

7. A warm air training model breathing apparatus comprising:

a canister communicating with ambient atmosphere through which a user inhales and exhales, said canister having a first opening for receiving exhaled air from a user and supplying inhaled air to a user and a second opening communicating with ambient atmosphere, said canister containing, between said first and second openings, a reagent which creates heat by reaction with carbon dioxide and/or moisture in exhaled air, said canister including passage means for directly passing inhaled air from said second opening through said reagent where is is heated and through said first opening to a use and passing exhaled air from a user from said first opening, through said reagent causing generation of heat and through said second opening to ambient atmosphere.

* * * * *